United States Patent [19]

Mabuchi et al.

[11] 4,160,253

[45] Jul. 3, 1979

[54] RADIO CONTROLLED, BATTERY-OPERATED MODEL TOY

[75] Inventors: Kenichi Mabuchi; Yoshihisa Tsuchimochi; Koziro Komatsu, all of Tokyo, Japan

[73] Assignee: Mabuchi Motor Co. Ltd., Tokyo, Japan

[21] Appl. No.: 717,486

[22] Filed: Aug. 25, 1976

[30] Foreign Application Priority Data

Aug. 28, 1975 [JP] Japan ..... 50-104302

[51] Int. Cl.[2] ..... H04B 7/00

[52] U.S. Cl. ..... 343/225; 343/228; 46/254; 318/16; 323/1; 335/6; 328/267; 244/190

[58] Field of Search ..... 343/225, 228; 318/16; 46/249, 254; 361/7, 8, 9 R; 335/6, 14, 15, 20; 328/267, 260; 325/492, 494, 362; 323/1, 15; 307/297; 244/189, 190

[56] References Cited

U.S. PATENT DOCUMENTS

| | | | |
|---|---|---|---|
| 2,358,357 | 9/1944 | Stilwell | 335/14 |
| 3,029,371 | 4/1962 | Saito | 343/225 |
| 3,247,339 | 4/1966 | Miller | 335/6 |
| 3,646,560 | 2/1972 | Barlow | 318/16 |
| 3,832,691 | 8/1974 | Galler | 343/225 |
| 3,878,521 | 4/1975 | Licitis et al. | 343/225 |
| 3,908,353 | 9/1975 | Graziano | 58/125 C |
| 3,937,911 | 2/1976 | Mabuchi et al. | 46/249 |
| 3,957,230 | 5/1976 | Boucher et al. | 46/249 |

*Primary Examiner*—John W. Caldwell, Sr.
*Assistant Examiner*—Donnie L. Crosland

[57] ABSTRACT

A radio controlled, battery-operated model toy having an electric motor, a battery device for supplying energy to the electric motor, a radio control receiver, and a servo mechanism operated by the output of the receiver, wherein a voltage responsive automatic circuit breaker which opens the electric circuit of the electric motor in response to a voltage drop in the battery device and holds the circuit in the open stage is provided between the battery device and the electric motor, and a voltage regulator/noise filter is provided between the battery device and the radio control receiver.

4 Claims, 4 Drawing Figures

RADIO CONTROLLED, BATTERY-OPERATED MODEL TOY

BACKGROUND OF THE INVENTION

1. Field of the Invention

This invention relates generally to a radio controlled, battery-operated model toy, and more specifically to a radio controlled, battery operated model toy in which a battery device for supplying energy to an electric motor is used to supply power to both a radio control receiver and a steering servo mechanism so as to make full use of the reserve power of the battery device.

2. Description of the Prior Art

In general, radio controlled model airplanes, radio controlled model ships and other radio controlled model toys have a separate battery device as a power supply for a radio control receiver and a steering servo-mechanism in addition to a battery device for supplying electric power to an electric motor which drives a propeller.

In recent years, nickel-cadmium batteries have been increasingly used as an energy source for electric motors for the following reasons; nickel-cadmium batteries are small in size, light in weight, have an extremely small internal resistance, and provides a large discharge power relative to its weight. In addition, the terminal voltage drop of these Ni-Cd batteries is very small compared with conventional manganese batteries despite of large discharge current, resulting in long effective discharging time.

In model toys, an extremely low supply voltage is inconvenient in practical use since low supply voltage requires large current to obtain the required power and tends to drop because of the resistance of lead wires. Therefore, several Ni-Cd batteries with the terminal voltage of approx. 1.2 V are usually connected in series. An individual Ni-Cd battery can be recharged even after it has been discharged to nearly zero voltage. However, when used in series connection, some batteries may often be depleted faster than others. In such a case, the polarity of the depleted batteries is apparently reversed by the current supplied by other batteries, leading to reverse charging and eventually permanent deterioration of batteries. For this reason, special consideration is required to prevent excessive discharge in a battery device comprising series-connected batteries. For example, a device is known which automatically disconnects the battery device from the electric motor when an average voltage per battery in the battery device drops to approximately 0.7 V.

In the case of such a battery device, there is a possibility of reverse charging when supplying an electric motor requiring a discharge current of, for example, 10 A, as mentioned above, but there is a sufficient reserve power when supplying a load of for example, 300 mA. Therefore, it is desired that a battery device is used not only as a power supply for the electric motor but also as a power supply for the radio control receiver and the steering servo-mechanism to use the above mentioned reserve power in driving the receiver and the servo-mechanism. Needless to say, it is required that batteries comprising a battery device be protected against reverse charging.

When a battery device is used as a common power supply for several purposes, the following points must be satisfied.

(1) Even when gradual voltage fluctuations occur in a battery device, these fluctuations should be regulated to such an extent that the radio control system can ignore it.

(2) When a pulse-shaped noise of relatively short period is generated in the battery device, such a noise should be almost perfectly filtered to an extent that the radio control system cannot pick it up.

(3) In a model toy such as a model ship which may drift away offshore beyond recovery because of depletion of power, power to the electric motor cannot be interrupted, unlike a model airplane, even when the terminal voltage of the battery device drops. It is necessary, therefore, to supply the electric motor with a sufficient level of electric current to prevent batteries comprising the battery device from reverse charging and yet to enable the model toy to be recovered, for example, a current of approx. 1 A.

SUMMARY OF THE INVENTION

An object of this invention is to provide a radio controlled, battery-operated model toy in which a battery device for driving the model toy is used as a power supply for a radio control receiver to make full use of the reserve power of the battery device.

Another object of this invention is to provide a radio controlled, battery-operated model toy in which a voltage responsive automatic circuit breaker is provided between the battery device and an electric motor for driving the model toy to prevent series-connected batteries, for example Ni-Cd batteries, comprising the battery device from being reverse charged.

Still another object of this invention is to provide a radio controlled, battery-operated model toy in which a voltage regulator noise filter is provided between the battery device and a radio control receiver to eliminate voltage fluctuations and noise in the battery device, thus preventing the unwanted operation of the radio control system.

A further object of this invention is to provide a radio controlled, battery-operated model toy, especially a model toy such as a model ship that requires a certain amount of energy to be safely recovered, in which a current control device is provided in parallel with the switch portion of the voltage responsive automtic cut-off device to supply the electric motor with a sufficient level of current to prevent batteries comprising the battery device from being reverse charged and yet to permit the model toy to be safely recovered.

DETAILED DESCRIPTION OF PREFERRED EMBODIMENTS

Figure 1:
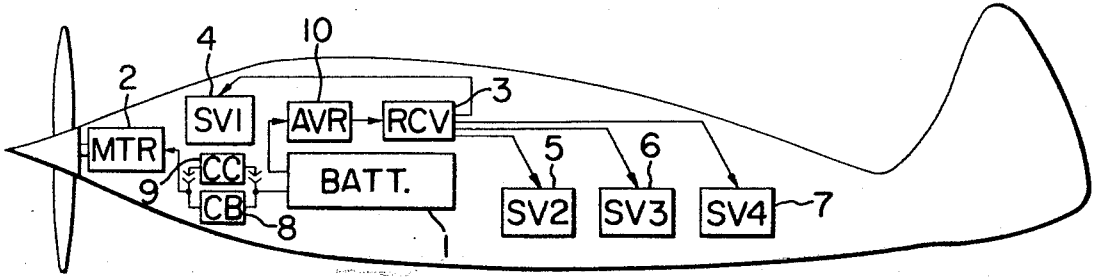
FIG. 1 is a block diagram illustrating a power supply system of a battery operated model toy embodying this invention.

In FIG. 1, numeral 1 refers to a battery device, numeral 2 to an electric motor, 3 to a radio control receiver, 4 through 7 to a steering servo-mechanism, 8 to a voltage responsive automatic circuit breaker, 9 to a current limiter, which is equipped in a model toy such as a model ship in which a certain amount of energy is required to permit the model toy to be recovered, and 10 to a voltage regulator/noise filter.

The battery device 1 comprising, for example, nine series-connected Ni-Cd batteries supplies the electric motor 2 with electric power via the voltage responsive automatic circuit breaker 8, and the electric motor in turn drives a propeller in the case of a model airplane. The battery device 1 supplies the radio control receiver 3 with electric power via the voltage regulator/noise filter 10. The radio control receiver 3 receives radio wave, for example from a ground transmitter to control the steering servo-mechanism 4 through 7.

Drive current supplied from the battery device 1 to the electric motor 2 in this case is approximately 10 A, and the current supplied from the battery device 1 to the receiver 3 is usually about 10 to 20 mA, and about 600 mA max. when the servo-mechanism 4 through 7 is being controlled.

Figure 2:
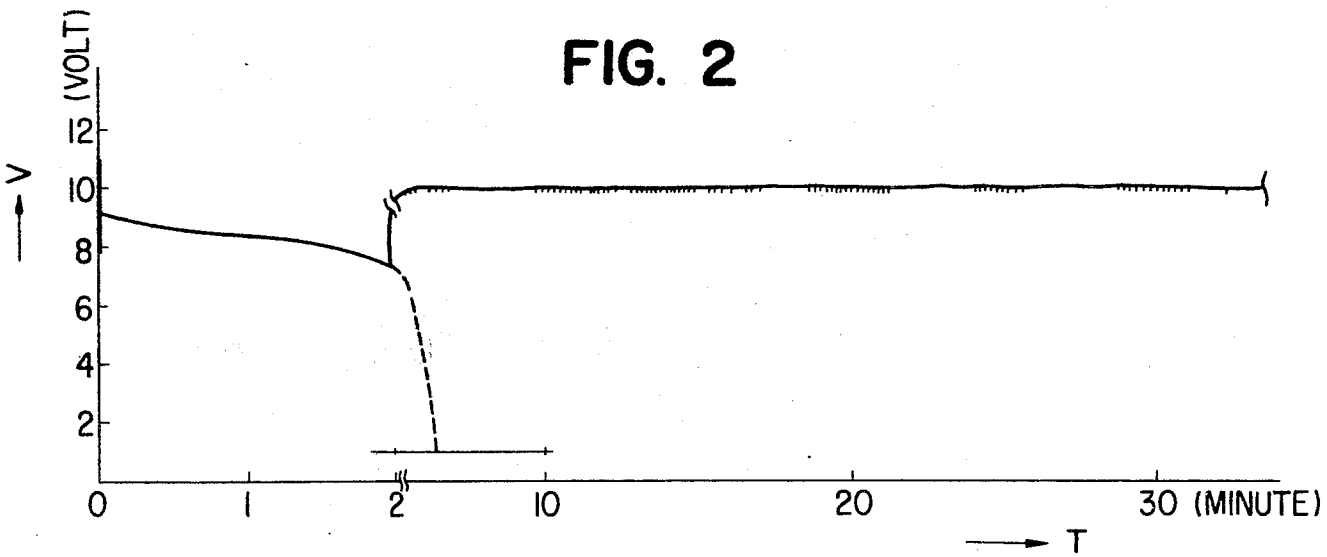
FIG. 2 is a graph showing the change of terminal voltage of the battery device in a battery-operated model toy embodying this invention.

The voltage responsive automatic circuit breaker 8 monitors the terminal voltage of the battery device 1, and operates to disconnect power to the electric motor 2 when the terminal voltage of the battery device 1 drops to, for example, nearly 7 V. The construction of the voltage responsive automatic circuit breaker 8 will be described later, referring to FIG. 3. When power is supplied from the battery device 1 to the electric motor 2 in FIG. 1, the terminal voltage of the battery device 1 changes as shown in FIG. 2. That is, as soon as power feeding is started, the voltage drops to less than 8 V, then increases to more than 9 V as the rotation of the electric motor increases, and again decreases to approx. 7 V as the electric motor 2 rotates at its full speed about two minutes after the start. If the voltage responsive automtic circuit breaker 8 is not in operation, the terminal voltage of the battery device 1 rapidly droops as shown by a dotted line in FIG. 2. In this invention, however, when the current limiter 9 is not provided, the voltage responsive automatic circuit breaker 8 operates to break the power supply to the electric motor 2. In other words, series-connected batteries in the battery device 1 is prevented from being unwantedly reverse charged. If the propeller shaft is locked for some reason or other, causing a shortcircuit current to flow, then the voltage responsive automatic circuit breaker 8 detects an abnormal drop of the terminal voltage of the battery device 1, and breaks the circuit of the electric motor 2.

On the other hand, when the current limiter 9 is provided, the voltage responsive automatic circuit breaker 8 operates to supply power to the electric motor 2 via the current limiter 9. Thus, a current of a sufficient magnitude to permit a model ship to be recovered, and yet to prevent the batteries from being reverse charged, or a current of, for example, 1 A is supplied to the motor 2.

Figure 3:
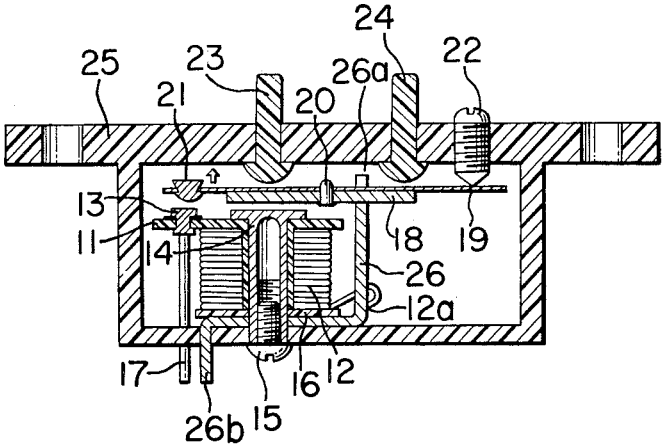
FIG. 3 illustrates a voltage responsive automatic circuit breaker to be used in this invention.

In this invention, when a current of about 10 A is continuously supplied to the electric motor 2 as shown in FIG. 2, the voltage responsive automatic circuit breaker 8 operates in about two minutes. Under this condition, however, the battery device 1 has a sufficient reserve power to drive a radio control system. FIG. 2 indicates this condition where the current limiter 9 is not provided. That is, when power supply to the electric motor 2 is interrupted, the terminal voltage of the battery device 1 recovers to about 10 V, and keeps the voltage at about 10 V, sufficient to drive a radio control system even after the lapse of more than 30 minutes. A slight droop of the voltage curve in FIG. 2 indicates that the steering servo-mechanism 4 through 7 is in operation. FIG. 3 illustrates a voltage responsive automatic circuit breaker 8 embodying this invention. In the figure, numeral 25 refers to a casing made of an insulating material such as plastics. 26 refers to a crank-shaped frame plate formed by a pure iron sheet, etc. at one end of which a notch **26*a* is formed and the other end of which forms a winding terminal 26*b* drawn out of the casing 25. The winding terminal 26*b* is connected to the negative terminal of the battery device 1 (FIG. 1, FIG. 4). 11 refers to a bobbin formed by an insulating material on which a winding is wound to form a coil 12. The beginning 12*a* of the coil 12 is soldered to the frame plate 26 and the end of the coil 12 is drawn out of the casing 25 from a location not shown in the figure, and is connected to the positive terminal of the battery device 1 (FIG. 1, FIG. 4). 13 refers to a fixed contact provided on the bobbin 11, and 14 is an iron core made of pure iron and fitted to the center of the bobbin 11. The iron core 14 together with the bobbin is fixed to the casing with a screw 15. Numeral 16 refers to a bobbin washer, and 17 to a contact terminal an end of which is connected to the fixed contact 13 and the other end of which is drawn out of the casing 25 to be connected to a terminal of the electric motor 2 (FIG. 1). 18 refers to a movable iron which is fitted to the notch 26*a* of the frame plate 26 and is rotated around the notch 26*a* as a fulcrum. 19 refers to a resilient metal plate having a movable contact 21 at one end, which is integrated with the movable iron 18 by a pin 20. 22 refers to an adjusting screw which is screwed to a location of the casing 25 opposing to the other end of the resilient metal plate 19 for adjusting the spring force of the resilient metal plate 19 and thus the circuit breaking level. 23 refers to a connecting push button for forcing the movable iron 18 onto the iron core 14, and 24 to a disconnecting push botton for separating the movable iron 18 from the iron core 14**.

Figure 4:
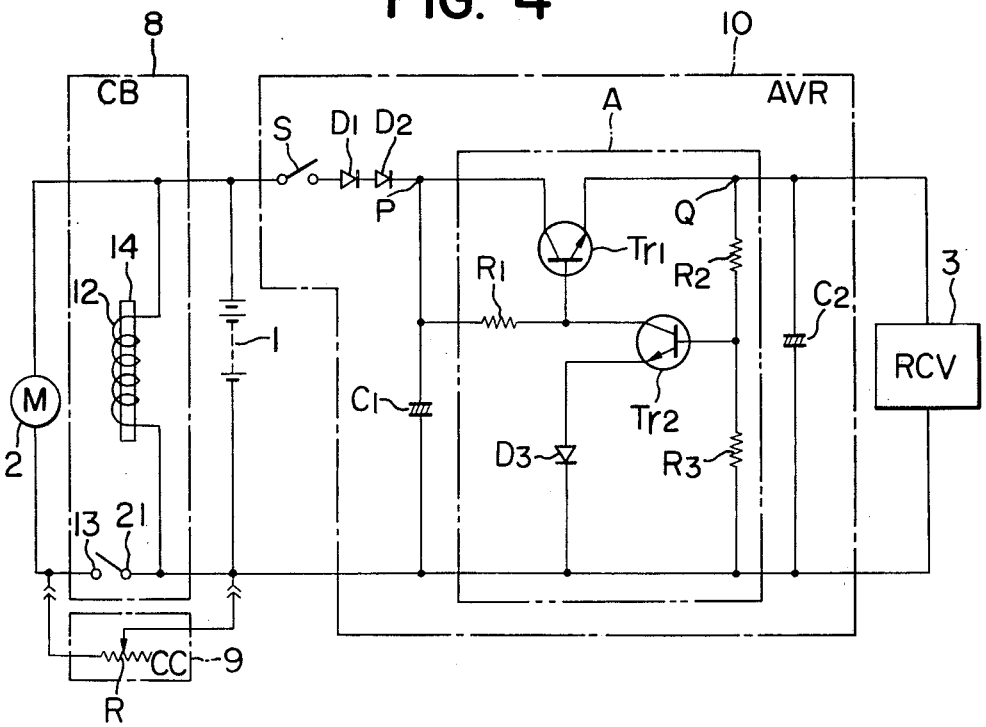
FIG. 4 is a circuit diagram of a battery-operated model toy embodying this invention.

As is evident from FIG 4, the coil 12 of the voltage responsive automatic circuit breaker 8 is connected to the terminals of the battery device 1. In this state, when the movable iron 18 is forced onto the iron core 14 by depressing the connecting push button 23, the movable iron 18 is kept attracted to the iron core 14 until the terminal voltage of the battery device 1 drops down to the predetermined level. And, at this time, the contacts 13 and 21 make to cause a driving current to be supplied from the battery device 1 to the electric motor 2, as shown in FIG. 4.

As the adjusting screw 22 is further screwed to the casing 25, the resilient metal plate 19 rotates around the notch **26*a* as the fulcrum to apply a bias force to the direction shown by an arrow, or the direction to separate the movable iron 18 from the iron core 14. When the terminal voltage of the battery device 1 slightly lowers, the force attracting the movable iron 18 to the iron core 14 decreasees. When the attracting force becomes smaller than the bias force, the contact 21 separates from the contact 13. In this way, the voltage level at which the contacts 13, 21 of the voltage responsive automatic circuit breaker 8 open is adjusted by the adjusting screw 22. The disconnecting push button 24 is used for forcibly opening the contacts 13, 21 which are kept in the closed condition, in an emergency or when needed. By depressing the push button 24, the movable iron 18 rotates clockwise around the notch 26a as the fulcrum to open the contacts 13, 21**.

FIG. 4 is a circuit diagram of a battery-operated model toy embodying this invention. In the figure, numerals 1, 2, 3, 8, 9, 10, 12, 13, 14, 21 correspond to like numerals in FIG. 1. A refers to a constant voltage circuit, C1 and C2 to capacitors, D1, D2, D3 to diodes, Tr1 to a current controlling transistor, Tr2 to a detecting transistor, R1 through R3 to resistors, R to a variable resistor, and S to a switch.

In FIG. 4, the current limiter 9 is provided as necessary in parallel with the switch portions 13 and 21 of the voltage responsive automatic circuit breaker 8. When the switch portions 13 and 21 are in the ON state, current does not flow in the variable resistor R, and power is fed from the battery device 1 to the electric motor 2 via the switch portions 13 and 21. When the terminal voltage of the battery device 1 drops to, say, nearly 7 V, as mentioned above, the voltage responsive automatic circuit breaker 8 operates to open the switch portions 13 and 21. In this state, power is supplied from the battery device to the electric motor 2 via the variable resistor R. In FIG. 1, the variable resistor R is set to have a resistance value that permits a current of, for example, about 1 A to flow. Thus, individual batteries in the battery device 1 are protected from reverse charging, and the electric motor 2 can continue to drive, for example, a propeller with a relatively weak power, permitting the model ship to be recovered. When the current limiter 9 is not provided, power is not supplied to the electric motor 2 after the switch portions 13, 21 are turned off. However, when the device of this invention is applied to a model airplane, the plane can be recovered by gliding even if power supply to the battery device is interrupted.

As is evident from FIG. 4, the battery device 1 serves not only as the power supply of the electric motor as described above, but also as the power supply of the radio control receiver 3.

In the constant voltage circuit A, the base current of the detecting transistor Tr2 is controlled in accordance with the voltage at the point Q in the figure. The base current of the current controlling transistor Tr1 is controlled by the collector current of the detecting transistor Tr2, and accordingly the collector current of Tr1 is also controlled.

Assuming the potential at the point Q in the figure slightly rises above the predetermined level in accordance with the voltage fluctuations at the point P, the base current of the detecting transistor Tr2 increases in proportion to the voltage increase, and its collector current also increases. This causes the base current of the current controlling transistor Tr1 to decrease, and thereby the collector current of the same transistor Tr1 decreases. As a result, the voltage at the point Q in the figure decreases, returning to the predetermined level. In this way, the voltage at the point Q in the figure is kept at an almost constant level even if the voltage of the battery device 1 gradually fluctuates.

In this invention, a filter circuit consisting of diodes D1 and D2 and a capacitor C1 and serving as a noise filter is provided to eliminate pulse-like noise of a relatively short period which may be generated in the battery device 1. The capacitor C1 is charged by the battery device 1 via the diodes D1 and D2 while the switch S is closed. Assuming the terminal voltage of the battery device 1 is 10 V and the forward voltage drop by the diodes D1 and D2 is 1 V, the capacitor C1 is charged to 9 V.

Now assume that noise of $\pm Vn$ V is superposed on the terminal voltage of the battery device 1. If this noise is of negative direction, the terminal voltage of the capacitor C1 remains at 9 V while the terminal voltage of the battery device 1 becomes $(10-Vn)$ V, and the noise content is cut off by the diodes D1 and D2 (the voltage drop of 1 V) and is not transmitted to the point P. If the superposed noise is of positive direction, the terminal voltage of the battery device 1 becomes $(10+Vn)$ V, causing the capacitor C1 to be charged at $(9+Vn)$ V, instead of 9 V, via the diodes D1 and D2. However, when the period of the noise is smaller than the time constant of the charging circuit, the voltage of the capacitor C1 hardly exceeds the level of 9 V. Even if the voltage slightly increases, such a voltage increase is a gradual one. Therefore, the increased voltage is completely cut off by the constant voltage circuit as described above, thus the potential at the point P being hardly affected by the noise.

As described above, this invention makes it possible to use a power supply for prime mover as a power supply for a radio control system in a battery-operated model toy. In a power supply using series-connected Ni-Cd batteries, this invention makes it possible to break a motor drive circuit before reverse charging occurs, and to operate a radio control system using the reserve power of batteries even after the motor drive circuit is disconnected.

In addition, this invention makes it possible to almost completely eliminate voltage fluctuations in the battery device 1 and noise generated in the electric motor 2 since a voltage regulator/noise filter is incorporated in this invention. Furthermore, even when the charging amount of the battery device 1 is held at a low level, the operating time of the radio control system is not affected after the driving current to the motor 2 is interrupted although the driving time of the motor 2 is reduced.

In a model ship and other model toys that require certain amount of driving energy for the toy to be recovered, this invention makes it possible to easily recover the model toy by providing a current limiter.

What is claimed is:

1. A radio controlled, battery-operated model toy, comprising a radio controlled receiver, an electric motor, a battery device for supplying energy to the motor through an electric supply circuit, a servo-mechanism coupled to and operated by the output from the radio controlled receiver, a voltage responsive automatic circuit breaker connected between the battery device and the electric motor which opens the electric supply circuit of the electric motor in response to a voltage drop of the battery device and maintains the circuit in an open state, and a voltage regulator/noise filter connected between the battery device and the radio controlled receiver, the voltage regulator/noise filter comprising a filter circuit consisting of at least one diode and a capacitor, said diode series-connected between the battery device and the capacitor, and a voltage regulating circuit connected in parallel with the capacitor, and wherein said at least one diode is connected in the forward direction between the positive terminal of the battery device and the capacitor to prevent discharge of the capacitor upon a voltage drop of the battery, and further comprising a detecting transistor which detects the output voltage of the voltage regulating circuit and whose base current is controlled by the detected output voltage, and wherein the voltage regulating circuit comprises a current controlling transistor which is connected between the diode and the radio controlled receiver and whose base current is controlled by the detecting transistor, whereby the output voltage is maintained at a predetermined level despite voltage fluctuations and pulse-like noise from the battery device, and wherein a current limiter is provided in series between the battery device and the electric motor to supply current to the electric motor by shunting the supply current from the battery device to the electric motor when the voltage responsive automatic circuit breaker operates.

2. A radio controlled, battery operated model toy as set forth in claim 1 further comprising a second capacitor connected in parallel across the output of the voltage regulating circuit.

3. A radio controlled, battery-operated model toy as set forth in claim 1 wherein the voltage responsive automatic circuit breaker comprises a coil series-connected across the battery device, a bobbin on which the coil is wound, a switch portion comprising a movable contact provided on one end of a rotatable resilient plate and a fixed contact provided on the side bobbin and facing the movable contact, a push button connected to engage the resilient plate to cause the movable contact to contact the fixed contact at the start of the power supply to the electric motor, said coil being energized by the power supply to provide a magnetic force which acts upon the contacts in the opposition to the resilient force of said resilient plate to thereby maintain said contacts in a closed state when sufficient power is supplied by the power supply, and an adjusting screw supporting the other end of the resilient plate and adjusting the resilient force to thereby adjust the switch-over level of the two contacts from the closed state to the open state, the switch portion being serially connected in said electric supply circuit to thereby open the electric circuit of the electric motor when the movable contact and the fixed contact open.

4. A radio controlled, battery-operated model toy as set forth in claim 1 wherein the current limiter comprises a variable resistor.

* * * * *